US005765811A

United States Patent [19]

Alberson et al.

[11] Patent Number: 5,765,811

[45] Date of Patent: Jun. 16, 1998

[54] GUARDRAIL TERMINAL

[76] Inventors: Dean C. Alberson, 2904 Westwood Main, Bryan, Tex. 77807; Delbert Lance Bullard, Jr., 2604 Briton Dr., Bryan, Tex. 77802

[21] Appl. No.: 820,717

[22] Filed: Mar. 18, 1997

[51] Int. Cl.[6] ..... E01F 15/04

[52] U.S. Cl. ..... 256/13.1; 256/65

[58] Field of Search ..... 256/13.1, 59, 65; 404/6, 9

[56] References Cited

U.S. PATENT DOCUMENTS

| | | | |
|---|---|---|---|
| 2,091,925 | 8/1937 | Heltzel | 256/13.1 |
| 2,146,445 | 2/1939 | Russert et al. . | |
| 2,154,818 | 4/1939 | Mayer . | |
| 3,643,924 | 2/1972 | Fitch . | |
| 3,776,520 | 12/1973 | Charles et al. . | |
| 4,508,319 | 4/1985 | Tappan et al. . | |
| 4,607,824 | 8/1986 | Krage et al. . | |
| 4,678,166 | 7/1987 | Bronstad et al. . | |
| 4,784,515 | 11/1988 | Krage et al. . | |
| 4,819,916 | 4/1989 | Wun-chung . | |
| 4,838,523 | 6/1989 | Humble et al. . | |
| 4,928,928 | 5/1990 | Buth et al. . | |
| 5,022,782 | 6/1991 | Gertz et al. . | |
| 5,078,366 | 1/1992 | Sicking et al. . | |
| 5,391,016 | 2/1995 | Ivey et al. . | |
| 5,503,495 | 4/1996 | Mak et al. . | |
| 5,507,473 | 4/1996 | Hammer et al. . | |

OTHER PUBLICATIONS

Sketch Nos. SEW05 sheets 1 and 6, SEW03a–b sheets 1 and 3.

Sketch Nos. SEW07, SEW11, SEW12.

*Primary Examiner*—Anthony Knight

*Attorney, Agent, or Firm*—David A. Tamburro

[57] ABSTRACT

A guardrail terminal end system for use at the upstream end of a W-beam guardrail mounted along the side of a roadway. The system includes a flat plate rail which extends horizontally along and is flared away from the roadway in a substantially straight linear direction and is supported by a plurality of horizontally spaced vertical break away posts. A vertical energy absorbing cylinder is supported by a vertical break away post which is located generally along the center line of the cylinder. The rail is operatively associated with the cylinder to attenuate the force of a vehicle impacting the cylinder. A transition shoe has a flat section which connects to the downstream end of the flat rail and a W-beam section which is adapted to connect to the standard W-beam guardrail. The cylinder distributes the load of an impacting vehicle equally on its support post to rapidly shear the post and cause bending or buckling of the flat rail which has low column strength in comparison to a W-beam rail. The flat rail bends or buckles on itself at each support post to create a failure mode at each post and thus absorb more energy from the impacting vehicle.

7 Claims, 4 Drawing Sheets

GUARDRAIL TERMINAL

BACKGROUND OF THE INVENTION

This invention relates generally to end terminals for W-beam guardrail systems and more particularly to a novel end terminal mounted at the upstream end of a W-beam guardrail for attenuating the impact energy of an errant vehicle striking the end of the guardrail and for avoiding penetration of the terminal components into the occupant compartment of the vehicle.

W-beam guardrails are conventional traffic barriers installed along the side of a roadway to prevent errant vehicles from leaving the roadway. Such guardrails must be installed so that the upstream terminal end of the guardrail facing the flow of traffic does not act as a hazard. Without proper termination at the end of the guardrail, impacting vehicles may become impaled on the guardrail causing intense deceleration of the vehicle and serious injury and in some cases death to its occupants.

To overcome such problems terminal end treatments have been proposed in the past and typical of those treatments are those described in U.S. Pat. Nos. 4,678,166, 4,928,928 and the other various prior art systems discussed in those patents such as the breakaway cable terminals (BCT), the slotted rail terminal (SRT) and the Sentre system.

In the system illustrated in U.S. Pat. No. 4,678,166 known as a modified eccentric loader terminal (MELT), the upstream end of the terminal formed by a standard W-beam is installed on a parabolic flare curving away from the roadway. An eccentric lever means is connected to the upstream end of the W-beam so that an impacting vehicle at the upstream end will facilitate buckling of the beam and allow the vehicle to pass behind the terminal end. While this system is reasonably efficient in attenuating the energy of the impacting vehicle it suffers from high initial costs and upon impact the W beam rail has a tendency to bend inwardly toward the roadway as shown in FIGS. 3B and 3C of the patent and, in some instances, may present an obstacle to the flow of traffic on the roadway.

In the system illustrated in U.S. Pat. No. 4,928,928 known in the industry as the ET 2000 system, the W-beam at the terminal end is forced through an extruder device to flatten the beam and then the flattened rail section is bent around a short radius and out a side chute to remove the end guardrail away from the impacting area and the roadway. This system while reasonably efficient in absorbing the energy of the impact and removing the column properties of the W-beam to prevent spearing of the errant vehicle, is a very costly system.

SUMMARY OF THE INVENTION

Accordingly the primary object of this invention is to provide a novel economical terminal end for a guardrail which efficiently attenuates and mitigates impact energy of an errant vehicle striking the end of the guardrail system and at the same time avoids spearing of the occupants of the vehicle by the terminal end.

Another object of the invention resides in the provision of the above novel terminal end installation which allows the terminal guardrail to gate and the vehicle to pass behind the rail, thus avoiding any significant secondary hazard to other motorists traveling on the roadway.

Still another object of the invention resides in the provision of the above novel terminal end wherein the end rail is formed by a flat plate maintained in tension along with the standard W-beam guardrail. The flat end rail possesses redirective capabilities when struck from the side by a vehicle and does so without detracting from the performance of the standard guardrail system with which it may be used.

Still another object of this invention resides in the provision of the above novel terminal end for a guardrail system wherein the flat terminal rail is flared in a substantially straight linear direction away from the standard W-beam guardrail. The terminal end includes a cylindrical vertically standing energy absorbing device at the exposed traffic end of the terminal rail, and the rail is maintained in tension along with the standard W-beam guardrail. Upon impact of a vehicle with the cylinder the flat plate rail which is incapable of developing significant column strength quickly bends or buckles and thereby prevents penetration of the rail into the occupant compartment of the vehicle. The energy of the vehicle is attenuated upon buckling of the flat rail and the terminal end installation gates the vehicle behind the flat rail and away from the roadway.

Other objects and advantages of this invention will become apparent from reading the following detailed description of the invention wherein reference is made to the accompanying drawings.

DETAILED DESCRIPTION OF THE INVENTION

Figure 1:
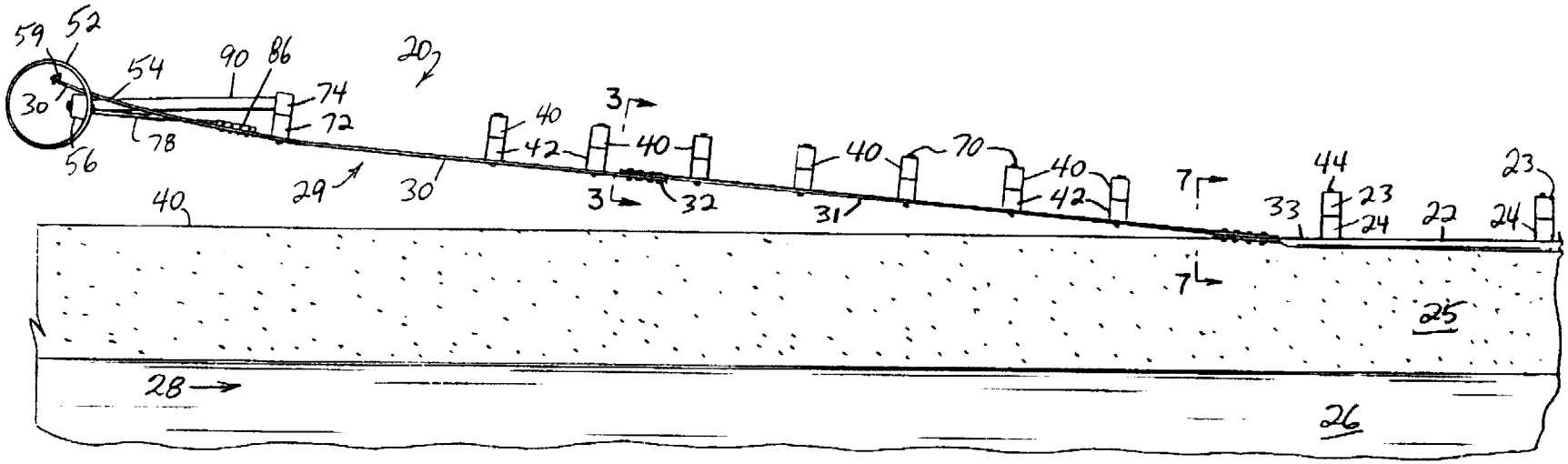
FIG. 1 is a fragmentary plan view of the novel guardrail terminal of the present invention.
Figure 2:
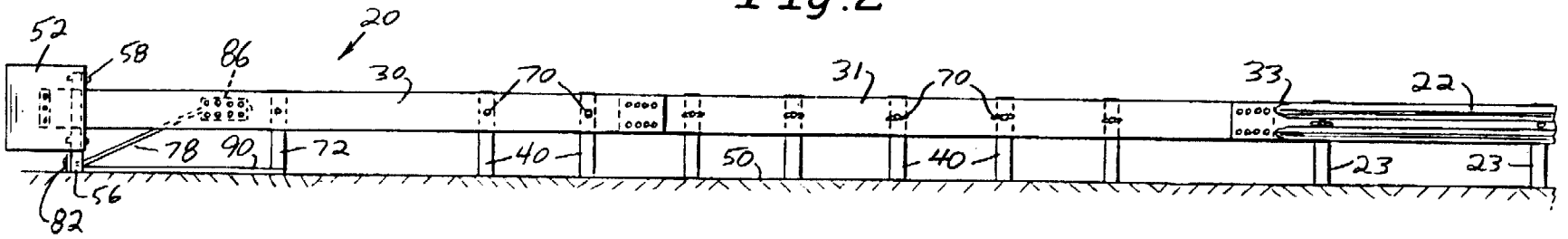
FIG. 2 is a front elevational view of the guardrail terminal illustrated in FIG. 1.
Figure 3:
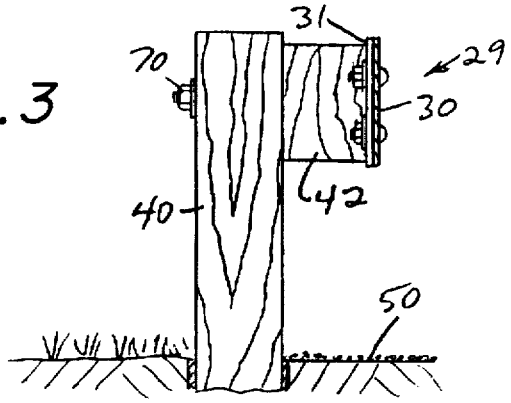
FIG. 3 is a fragmentary sectional view taken along line 3—3 of FIG. 1.

Referring now to FIGS. 1 and 2 of the drawings the novel guardrail terminal 20 of the invention is located at the upstream end of a standard W-beam guardrail 22 mounted via standard posts 23 and post blocks 24 along the shoulder 25 of highway 26 along which traffic moves in the direction of arrow 28.

Figure 7:
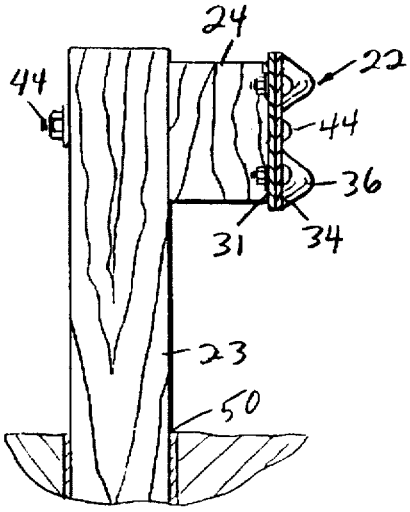
FIG. 7 is a fragmentary sectional view taken along line 7—7 of FIG. 1.
Figure 10:
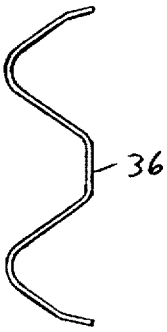
FIG. 10 is an end view of the transitional shoe taken along line 10—10 of FIG. 9.
Figure 8:
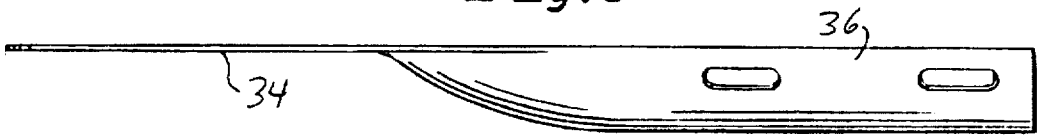
FIG. 8 is a plan view of the transitional shoe used to connect the flat terminal rail with the standard W-beam guardrail.
Figure 9:
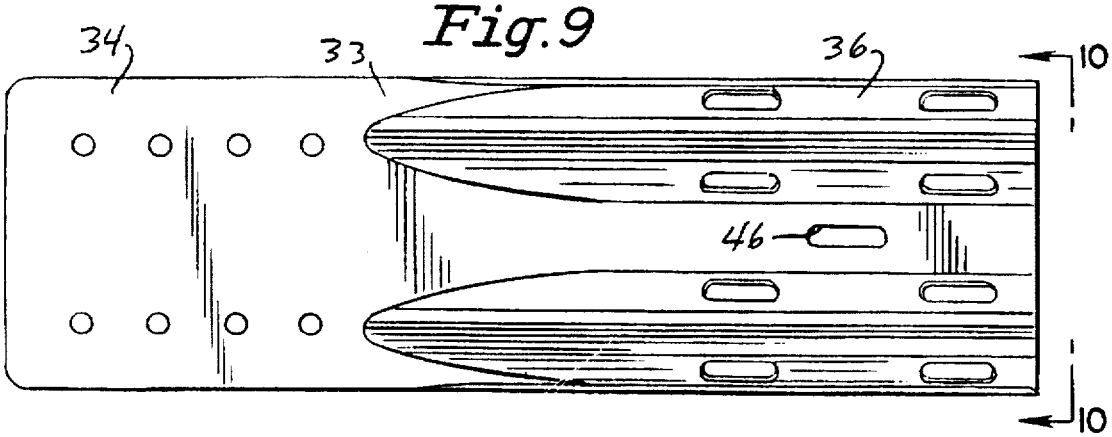
FIG. 9 is a front elevational view of the transitional shoe of FIG. 8.

Terminal end 20 comprises a flat rail 29 formed by flat steel plates 30 and 31 spliced together at 32, the plates being for example 3/16" thick and 12" wide to conform to the width of a standard 12" wide W beam 22. Flat plate 31 is connected to the W-beam guardrail 22 by way of a transition shoe 33 (FIGS. 8–10) having one flat end section 34 bolted to plate 31 and the other W shaped section 36 bolted to guardrail 22. Plates 30 and 31 flare linearly away from a line 40 which is a tangent line projected from the face of the last two post blocks 24 of the standard post section supporting guardrail 22 and shoe 33. Plates 30 and 31 are supported from the ground by a plurality of standard wooden CRT breakaway posts 40 having post blocks 42 fastened thereto. Plates 30 and 31 are connected to blocks 42 for example by ¼" by 1½" lag bolts 70 passing through slots 35 in plates 30 and 31, and shoe 33 is connected to post 23 and block 24 by a bolt 44 extending through a slot 46, block 24, and post 23 (FIG. 7).

Posts 40 are standard 6"×8"×6' wooden CRT breakaway posts having drilled holes at or below ground line 50 to make them break away.

At the outermost end of terminal 20 a cylindrically shaped vertically standing energy absorbing device 52 supported by a wooden breakaway post 56 which extends vertically inside cylinder 52 along its centerline and is fastened thereto by bolts 58. Post 56 is 6"×8"×4' long and extends downwardly into a steel foundation tube 60 which is about 6' long below ground level 50.

Cylinder 52 is typically 30" in diameter by 30" tall by 3/16" thick, grade 50 steel and is fixed to post 56 with its bottom edge 62 spaced 6" above ground level 50.

Plate 30 is also connected by a lag bolt 70 through slot 35 to a post block 72 fastened to a wooden breakaway post 74 5½"×7½"×3'6½" long and contained in a steel foundation tube 76 below ground level 50.

Figure 4:
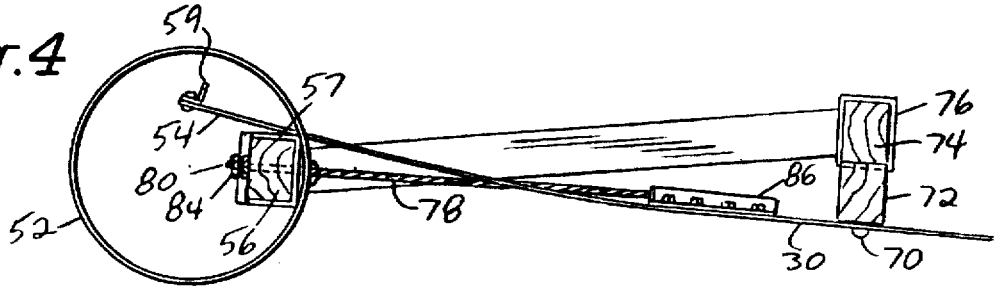
FIG. 4 is an enlarged fragmentary plan view of the approach or upstream end of the guardrail terminal of the present invention.
Figure 5:
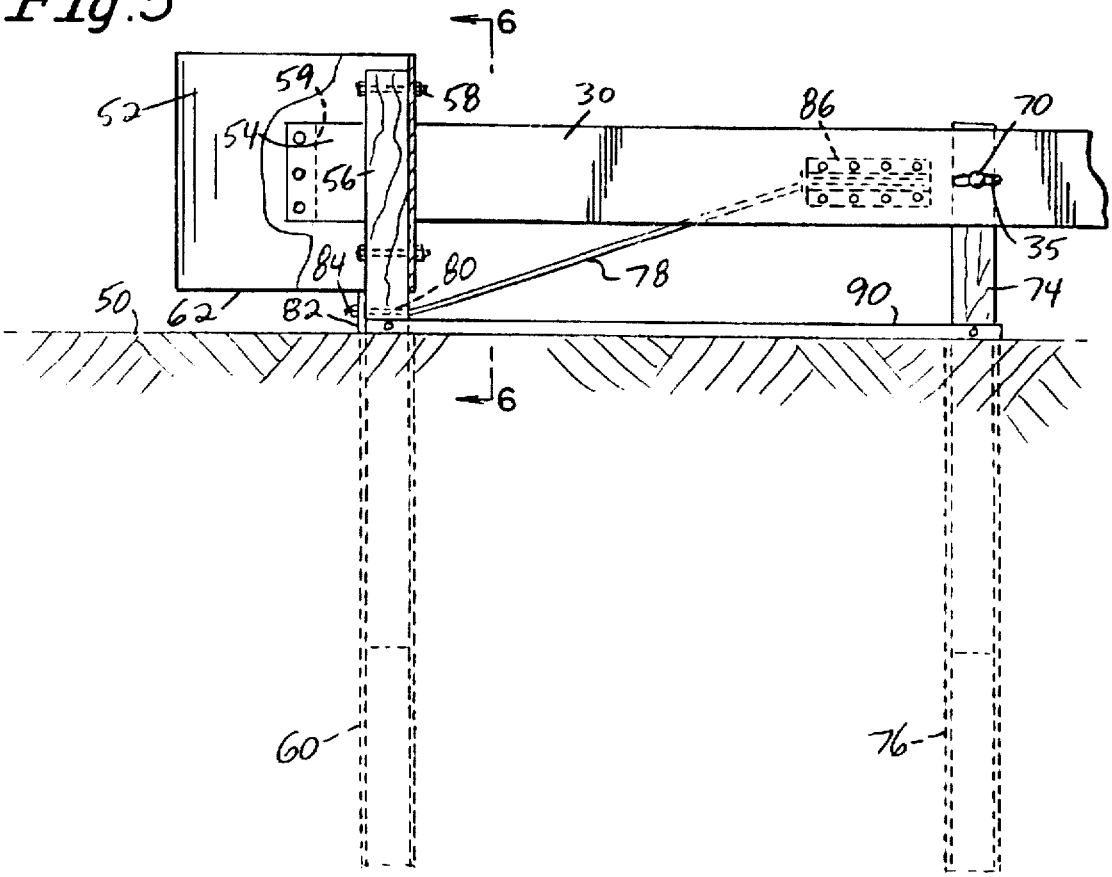
FIG. 5 is a front elevational view taken along line 5—5 of FIG. 4.
Figure 6:
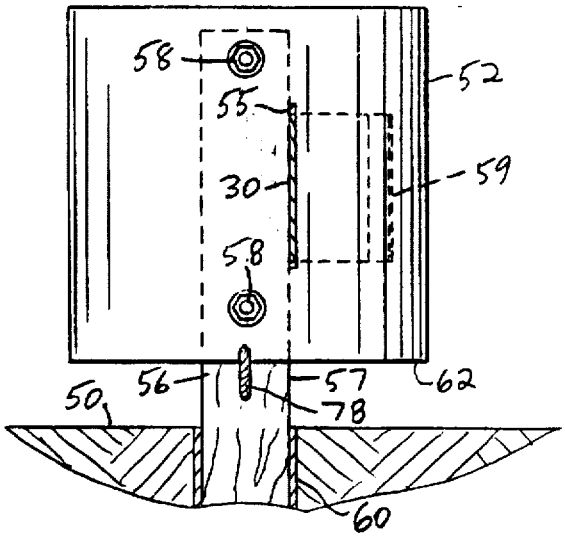
FIG. 6 is a fragmentary sectional view taken along line 6—6 of FIG. 5.

The outermost portion 54 of plate 30 is bent rearwardly around block 72 so that it passes through a vertical elongated slot 55 (FIGS. 4 and 6) in the sidewall of cylinder 52 into the interior of the cylinder. Slot 55 is offset rearwardly of the centerline of post 56 so that plate 30 engages freely against the back edge 57 of post 56 under its own spring force. A piece of angle iron 59 is fixed on the outer end of plate 30 to aleviate any sharp piercing edge on the plate and to retain cylinder 52 on plate 30 after vehicle impact and breakage of post 56.

A standard breakaway anchor cable 78 has its outer threaded end 80 extending through post 56 and a bearing plate 82, with a nut 84 on end 80 bearing against the outer surface of plate 82. The inner end of anchor cable 78 is fastened by connector 86 to the outside surface of plate 30 and as the cable is tightened by taking up nut 84, tensile forces are applied to rail 29 and guardrail 22 to redirect vehicles impacting against rail 29 and guardrail 32 back towards roadway 26.

A ground strut 90 extends between and is connected to the first two posts 56 and 74 at ground level and acts to resist cable loads which are caused by impacts downstream of the connector 86.

In a prototype installation of the invention the overall length of the flat rail terminal installation from the post 23 to which shoe 33 is connected to the first post 56 was approximately 37 feet, 6inches. Rail 29 flared away from tangent line 40 along a straight linear path from shoe 33 to post 74 and end portion 54 deviates slightly rearwardly of the linear path behind post 56. The lateral distance from post 56 to tangent line 40 as viewed in FIG. 1 was approximately 3feet. As viewed in FIG. 2 the longitudinal distance between post 56 and post 74 and between post 74 and the first post 40 was approximately 6'3" each and the space between each of the posts 40 was approximately 3'1½". The distance from the last post 40 to the first post 23 was 6'3", thus totaling 37 feet, 6 inches from post 23 to the first post 56. After cable anchor 78 is pulled tight by nut 84 to place rail 29 and guardrail 22 in tension, lag bolts 70 in slots 35 are tightened to hold plates 30 and 31 against blocks 72 and 42. Thus, prior to any impact, plates 30 and 31 are maintained in tension along with guardrail 22. The end portion 54 engages freely under its own spring force against the back edge of post 56.

Figure 11A:
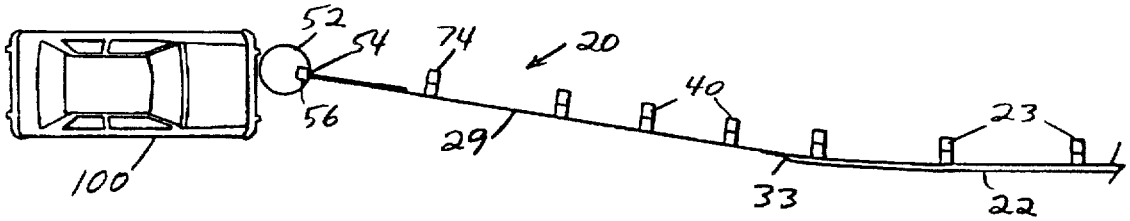
FIGS. 11*a*, 11*b*, 11*c* and 11*d* are plan views of the novel guardrail terminal of the present invention being impacted by a vehicle in a head-on collision wherein the vehicle bends the terminal and passes safely behind the terminal away from the normal traffic pattern of the highway.
Figure 11B:
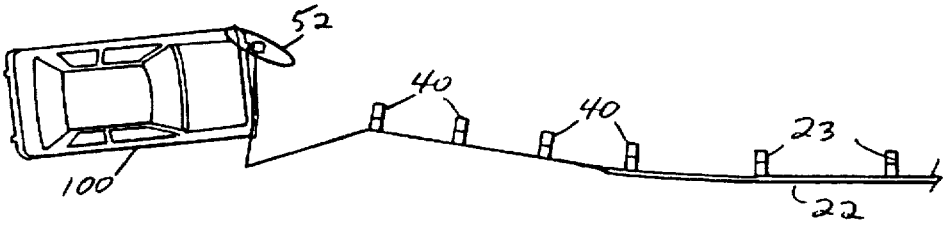
Figure 11C:
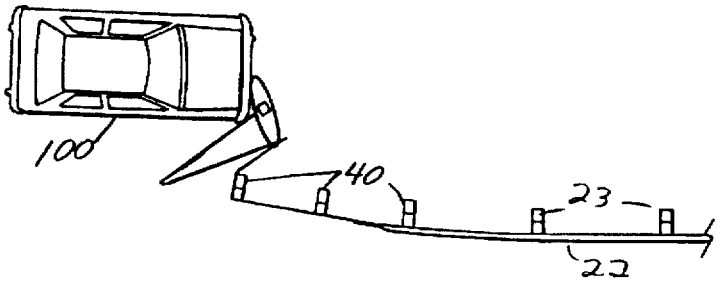
Figure 11D:
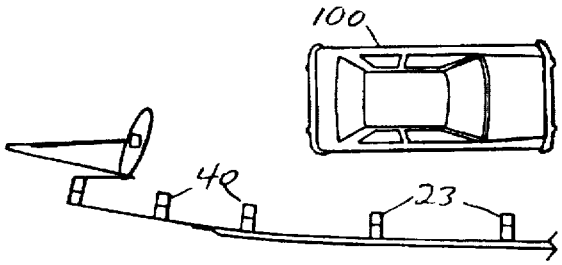

Referring now to FIGS. 11*a* through 11*d* the manner in which the novel terminal end 20 of the invention functions to attenuate and mitigate the impact energy of an errant vehicle 100 as it strikes the end of a flexible guardrail system will be described. As the vehicle strikes the energy absorbing cylinder 52, the impact force is equally distributed by the cylinder along its centerline on post 56 against the end portion 54 of rail 29. The impact force of vehicle 100 is attenuated and absorbed by the terminal end 20 as posts 56 and 74 are sheared and as the tensioned flat rail 29 is bent over upon itself. Because plates 30 and 31 are attached to posts 74 and 40, they bend or buckle on themselves at each post location and thus experience a failure mode at each post and absorb more energy than previous conventional guardrail terminal assemblies. Also, because flat rail 29 has less column strength than a conventional W-beam it more readily bends upon itself and avoids spearing of the occupants in the vehicle. As rail 29 buckles, the terminal 20 gates and allows the vehicle to pass through the terminal behind the guardrail 22 and out of the way of traffic passing along the roadway 26 as shown in FIGS. 11*c* and 11*d*. Also the rail bends in a direction away from roadway 26 behind the terminal end 20 so that no debris or sheared components of the terminal end are directed into the roadway, thus preventing harm to any other vehicles in the roadway. Because rail 29 is arranged on a substantially straight linear flare from tangent 40 and is maintained in tension along with the tensioned guardrail 22, when the rail is struck on the side by a vehicle it redirects the vehicle back toward the roadway 26 without detracting from the performance of the standard guardrail system 22 to which it is attached. The rail is normally maintained in tension and when it is struck by a vehicle the tension is increased to enhance the performance of the terminal end 20.

Because the end portion 54 of rail 29 is not connected to post 56 but rather passes freely behind the post through slot 55 into cylinder 52, any force imposed on rail 29 by redirective side hits is not borne by post 56 and thus premature shearing of post 56 is avoided.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A guardrail terminal for use at the upstream end of a W-beam guardrail mounted along the side of a roadway comprising a substantially flat rail extending horizontally along and flared away from said roadway in a substantially linear direction, a plurality of vertical breakaway posts for supporting said flat rail, a vertical energy absorbing cylinder at the upstream end of said flat rail and a vertical break away post connected to and supporting said cylinder generally along its center line, said flat rail being operatively associated with said cylinder to attenuate the force of a vehicle impacting on said cylinder, and a transition shoe having a flat section connected to the downstream end of said flat rail and a W-beam section adapted to be connected to said W-beam guardrail.

2. The guardrail terminal defined in claim 1, comprising means connecting said rail to said breakaway posts.

3. The guardrail terminal defined in claim 2, comprising means for maintaining said flat rail and said W-beain guardrail in tension.

4. The guardrail terminal defined in claim 1, wherein said cylinder supporting post is mounted within said cylinder.

5. The guardrail terminal defined in claim 4, wherein said cylinder includes a vertical slot and said flat rail has an upstream end portion extending through said slot into said cylinder.

6. The guardrail terminal defined in claim 5, wherein said slot is located on said cylinder so that said end portion of said rail is positioned behind said cylinder supporting post.

7. The guardrail terminal defined in claim 1, wherein said flat rail has a height corresponding to the height of said W-beam guardrail.

* * * * *